US006422032B1

(12) United States Patent
Greene

(10) Patent No.: US 6,422,032 B1
(45) Date of Patent: Jul. 23, 2002

(54) REUSABLE COOLER BAG

(76) Inventor: Gary Keith Greene, 135 Tall Pines Rd., Ladson, SC (US) 29456

( * ) Notice: Subject to any disclaimer, the term of this patent is extended or adjusted under 35 U.S.C. 154(b) by 38 days.

(21) Appl. No.: 09/769,235

(22) Filed: Jan. 24, 2001

(51) Int. Cl.[7] ..... F25D 3/08
(52) U.S. Cl. ..... 62/457.2; 62/530
(58) Field of Search ..... 62/457.1, 457.2, 62/371, 530

(56) References Cited

U.S. PATENT DOCUMENTS

| | | | | |
|---|---|---|---|---|
| 4,196,817 A | | 4/1980 | Moser | |
| 4,211,091 A | | 7/1980 | Campbell | |
| 4,211,267 A | | 7/1980 | Skovgaard | |
| 4,228,908 A | | 10/1980 | Tweeton | |
| 4,250,998 A | | 2/1981 | Taylor | |
| 4,338,795 A | | 7/1982 | House, Jr. | |
| 4,521,910 A | | 6/1985 | Keppel et al. | |
| 4,530,220 A | | 7/1985 | Nambu et al. | |
| 4,637,063 A | | 1/1987 | Sullivan et al. | |
| 4,831,842 A | | 5/1989 | Kelley et al. | |
| 5,005,374 A | * | 4/1991 | Spitler | 62/259.3 |
| 5,361,603 A | * | 11/1994 | Merritt-Munson | 62/457.2 |
| 5,490,396 A | * | 2/1996 | Morris | 62/457.2 |
| 6,151,910 A | * | 11/2000 | Hazen | 62/457.2 |

* cited by examiner

*Primary Examiner*—William Doerrler
*Assistant Examiner*—Melvin Jones
(74) *Attorney, Agent, or Firm*—Harleston Law Firm; Kathleen M. Harleston

(57) ABSTRACT

A reusable, multi-walled cooler bag for maintaining a cool temperature within the bag includes: (a) a front portion comprised of at least one front layer; (b) a rear portion comprised of at least one rear layer, the layers being identical to one another, the front portion being sealed to the rear portion along at least two of its edges, the bag having a closable opening at its upper end; and (c) a reclosable fastener mechanism for opening and closing the opening in the bag; wherein the front or rear portions hold nontoxic coolant material between the front and/or rear layers; and the bag has a water-tight interior for storing items to be kept cool.

7 Claims, 5 Drawing Sheets

REUSABLE COOLER BAG

BACKGROUND OF THE INVENTION

1. Technical Field

The present device is a reusable, multi-walled cooler bag, with a reclosable fastener mechanism, for storing and keeping items cool.

2. Background Information

Each weekday morning, parents all over America are inserting frozen packs of coolant into their children's lunch boxes to keep their sandwiches and drinks cool until lunch time at school. Unfortunately, these packs of coolant seem to disappear in the recesses of the freezer or on the trip home from school. Also, they often will not fit into the lunch box, or do not properly cover the desired item, or they cool one side of the lunch, but not the other. The coolant packs are often soiled from contact with food items or spilled beverages. The same is true of packing beverages for ball games, snacks for long car trips, etc.

These problems and others have been solved by the inexpensive, reusable cooler bag of the present invention. This easy to use, double-lined cooler bag for storing items and keeping them cool has a thin layer of coolant between each double liner on the front and rear portions of the bag. A user places the bag in a conventional freezer prior to using it. The bag ensures that items inside are stored at an appropriate cool temperature for hours. A reclosable fastener mechanism at the top of the bag keeps items in place inside, and also helps maintain a cool temperature inside the bag.

With the present invention, there is no need to locate separate, ill-fitting commercially available packs of frozen coolant, or to try to fit oddly shaped frozen packs of coolant into a small, packed lunch box. Since the bag and coolant are in one unit, a step in packing lunches/ beverages is saved. The cooler bag of the present invention maintains an even, cool temperature across the entire inside of the bag. This cooler bag can easily be cleaned and reused. Since it is inexpensive, it can easily be disposed of if it becomes worn or overly soiled.

BRIEF SUMMARY OF THE INVENTION

The present invention is a reusable, multi-walled cooler bag for maintaining a cool temperature within the bag. The bag includes:

(a) a front portion comprised of at least one front layer, the front layers being identical to one another;

(b) a rear portion comprised of at least one rear layer, the rear layers being identical to one another, the front portion being sealed to the rear portion along at least two of its edges, the bag having a closable opening at its upper end; and (c) a reclosable fastener mechanism for opening and closing the opening in the bag; and wherein the front or rear portions further comprise non-toxic coolant material between at least two of the front or rear layers; and wherein the bag has a water-tight interior for storing items to be kept cool.

BRIEF DESCRIPTION OF THE SEVERAL VIEWS OF THE DRAWINGS

A more complete understanding of the invention and its advantages will be apparent from the following detailed description taken in conjunction with the accompanying drawings, wherein examples of the invention are shown, and wherein.

DETAILED DESCRIPTION OF THE INVENTION

Figure 1:
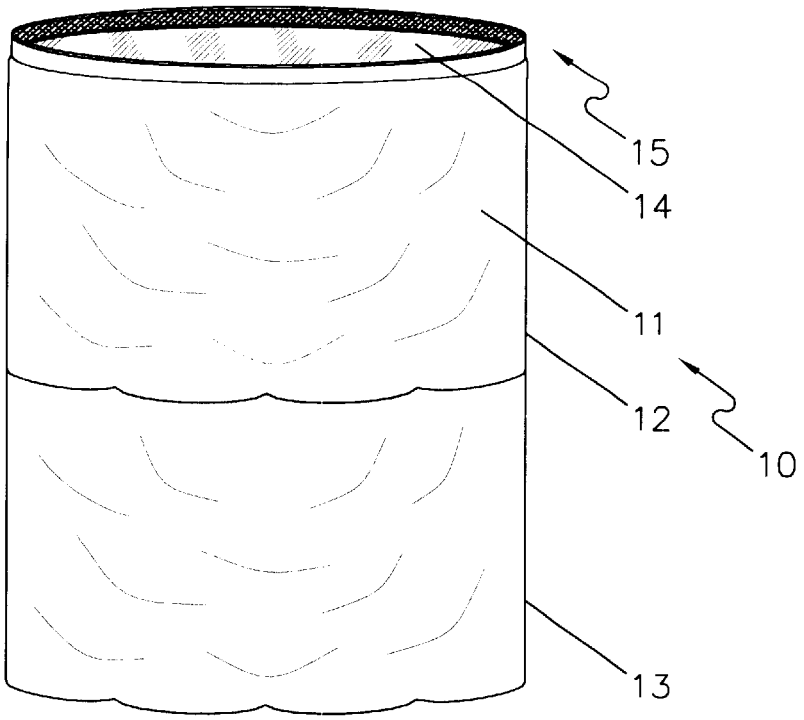
FIG. 1 is a perspective view of a cooler bag according to the present invention.
Figure 2:
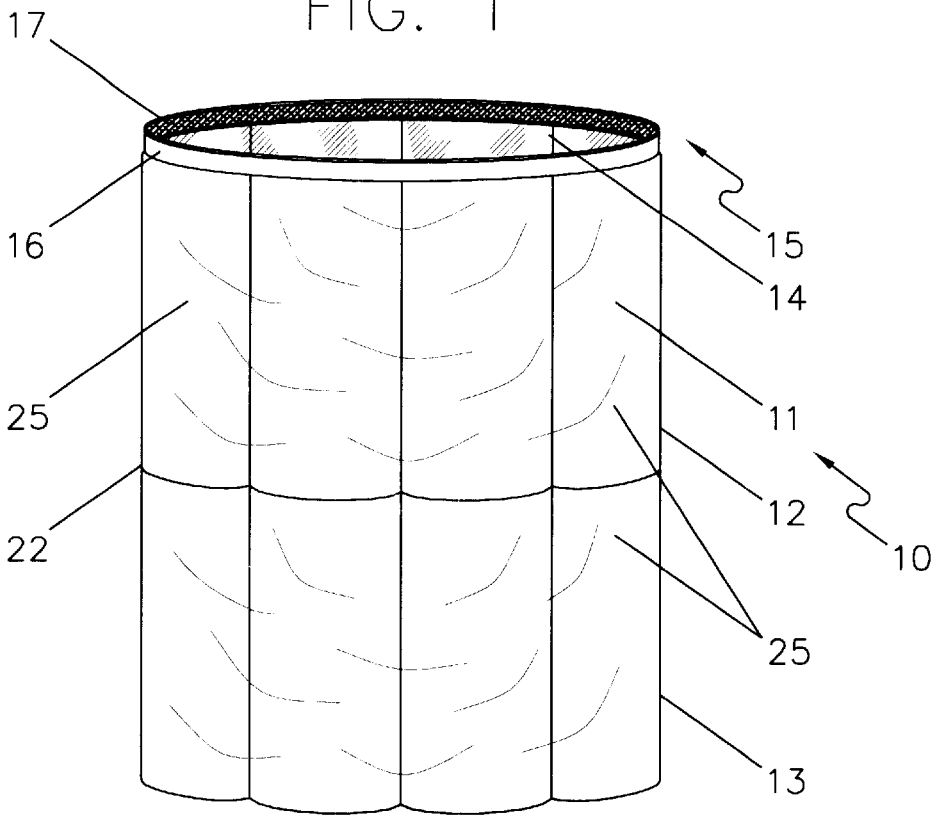
FIG. 2 is a perspective view of a second, alternate embodiment of a cooler bag according to the present invention.
Figure 3:
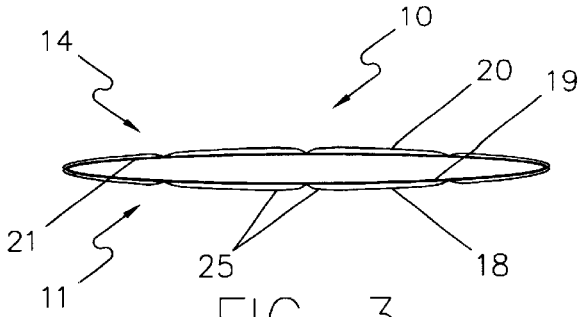
FIG. 3 shows a cross section of the cooler bag of FIG. 2.

In the following description, like reference characters designate like or corresponding parts throughout the several views. Also, in the following description, it is to be understood that such terms as "front," "rear," "within," and the like are words of convenience and are not to be construed as limiting terms. Referring in more detail to the drawings, the invention will now be described.

Turning first to FIG. 1, a deformable, reusable bag, generally referred to as 10, is usable as a sealable container for holding one or several items and keeping them cool. Although it can be used for other items, it is primarily intended to contain food or beverage containers, such as 12 ounce soda cans or baby bottles. The bag may be made in various sizes, so it will accommodate, for example, a lunch, a six pack of beer, a dozen brownies, or a baby bottle and baby food. The front portion 11 of the bag 10 shown in FIG. 1 is divided into an upper quadrant 12 and a lower quadrant 13. The rear portion 14 of the bag 10 mirrors the front of the bag. The front portion 11 of the bag 10 is sealed to the rear portion 14 of the bag along both opposite sides. The bag 10 folds relatively flat when not in use.

Continuing with FIG. 1, the bag comprises a resealable fastener mechanism 15 at the top. The fastener mechanism 15 is preferably two complementary strips of lock and loop material, with a first strip 16 of lock and loop material attached to the front portion 11 of the bag along its top edge, and a second, complementary strip 17 attached to the rear portion 14 of the bag along its top edge. To fasten the bag after inserting items in it, a user holds the bag with one hand and runs a thumb and forefinger along the outside of the lock and loop strips, beginning at one end of the bag and finishing at the opposite end. To unfasten the bag, the user can grasp the front of the bag at the top with one hand and the rear of the bag at the top with the other hand, and pull the two strips of lock and loop material apart.

To use the cooler bag of the present invention, a user places it inside a conventional freezer for a period of time sufficient to cool the coolant material in the bag, for example, overnight. The bag may be stored flat or upright in the freezer. After removing the bag 10 from the freezer, the user places the desired items in the bag, and seals the fastener mechanism 15 at the top of the bag. The sealed bag will normally maintain a cool internal environment for a number of hours, especially if the items are already cool when they are placed in the bag. Also, freezable items can be placed inside the bag prior to its placement in the freezer, and frozen with the bag. These items would stay cool even longer at room temperature. If desired, an item, e.g., a can of soda, may be removed from the bag, and the bag may be resealed for continued cooling of the remaining items in the bag.

FIGS. 2 through 6 illustrate a second, alternate embodiment of a resealable bag according to the present invention. In this embodiment, each upper and lower quadrant 12, 13 of the bag is divided into fourths. As shown in the latitudinal cross section of the bag shown in FIG. 3, the front portion 11 comprises two front walls 18, 19, and the rear portion 14 of the bag comprises two rear walls 20, 21. All four walls are most preferably identical to one another in size. In between the front walls 18, 19 is a conventional, freezable coolant, and likewise for the rear walls 20, 21. Two of the walls 19, 21 face inwards towards the inside of the bag, and two of the walls 18, 20 face outward. The front walls are sealed to each other on all four sides, and the same is true of the two rear walls. Thus, outer front wall 18 is attached to inner front wall 19 on all four side edges, with a coolant in between. Similarly, outer rear wall 20 is attached to inner rear wall 21 on all four side edges, with coolant in between the two layers.

Figure 4:
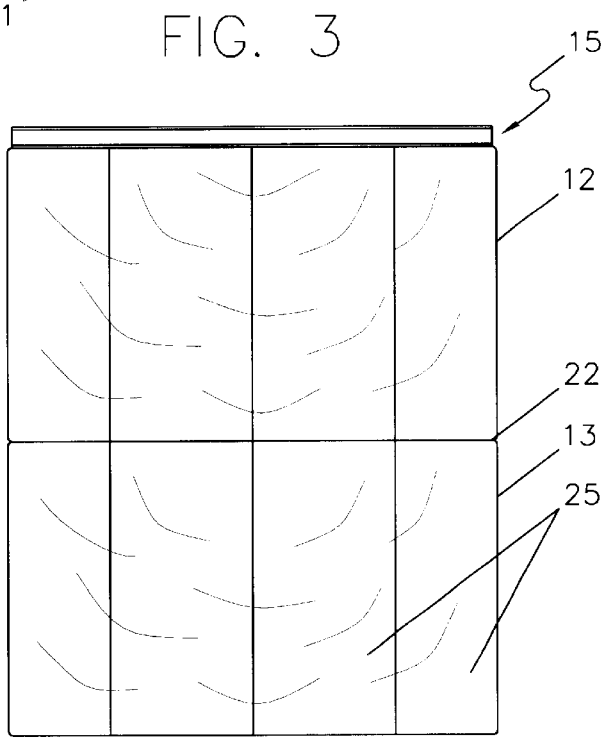
FIG. 4 is a front elevational view of the cooler bag of FIG. 2.
Figure 6:
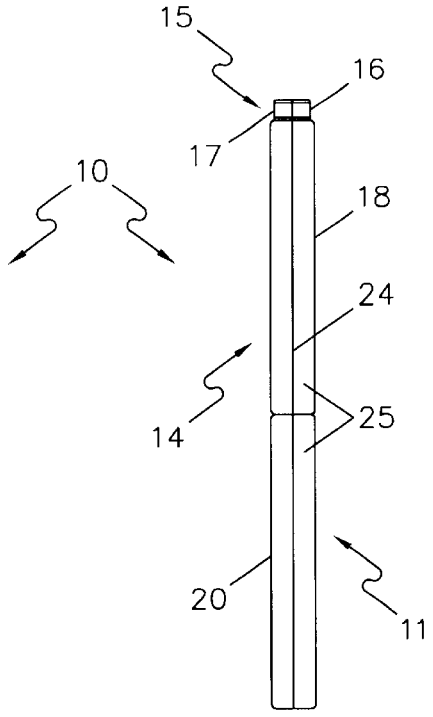
FIG. 6 is a side elevational view of the cooler bag of FIG. 2, the opposite side being a mirror image of the side shown in FIG. 6.
Figure 5:
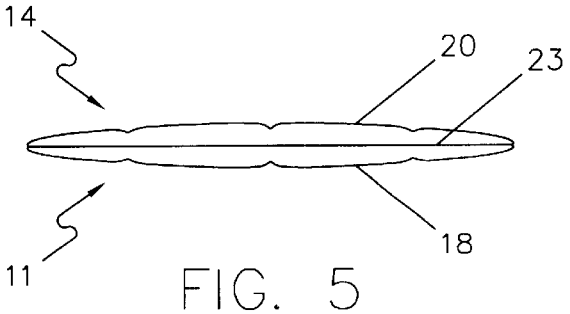
FIG. 5 is a bottom plan view of the cooler bag of FIG. 2.

Continuing with FIGS. 4–6, the bag 10 may be folded along a front center seam 22 when it is not in use for easier storage (see FIG. 4). As shown in FIG. 5, the bottom of the bag has a bottom central seam 23, where the front portion 11 is seamed to the rear portion 14. In constructing the bag, some of the layers may be formed from a single piece of material which is folded along one edge and then sealed along two opposite side edges. Once the thin layer of coolant is inserted between the inner and outer layers, the fourth side is sealed. This forms the front, or rear, portion of the bag. A side seam 24 is shown in FIG. 6.

It is preferred that all four layers be made of the same material, most preferably plastic. The bag 10 may further comprise an inner liner (e.g., rubber) for reinforcement, and/or an outer material (e.g., fabric). These additional layers would cushion the contents of the bag, and protect the double layers from inadvertent punctures from inside or outside the bag.

The embodiment shown in FIGS. 2–6 has a total of sixteen compartments 25. The compartments hold the coolant in place, so that, for example, the coolant does not leak down to the lower part of the bag when the bag is upended. The compartments 25 keep the coolant evenly distributed over the bag, so that the bag's contents are evenly cooled. Since it is evenly distributed, a thin layer of coolant is sufficient, depending on the particular coolant being employed. The bag is therefore lightweight and yet effective in cooling the bag's contents. This "quilted" bag, where the quilt seams form multiple compartments (e.g., 8–64 compartments), is preferred where the bag 10 is large in size. The compartments 25 keep the coolant evenly distributed, and the whole bag is not ruined if one compartment is accidentally punctured. The compartments can be formed, for example, by seaming the outer front wall 18 to the inner front wall 19, or the outer rear wall 20 to the inner rear wall 21, along the "quilt" lines before the coolant is added. Seams can be made, for example, by gluing or heat treating the plastic.

Thus, the bag 10 includes: (a) a front portion 11 comprised of at least one front layer, the front layers, or walls 18, 19, being identical to one another; (b) a rear portion 14 comprised of at least one rear layer, the rear layers, or walls 20, 21, being identical to one another, the front portion 11 being sealed to the rear portion along at least two of its edges, the bag 10 having a closable opening at its upper end; and (c) a reclosable fastener mechanism 15 for opening and closing the opening in the bag. The front or rear portions 11, 14 further comprise nontoxic coolant material between at least two of the front 18, 19 or rear layers 20, 21; and the bag has a water-tight interior for storing items to be kept cool. The front and rear portions are preferably generally rectangular in shape, and each comprise two of the layers: an inner layer, or wall 19, 21 bordering the interior of the bag, and an outer layer, or wall 18, 20, on the exterior of the bag, each portion comprising the coolant material between the layers. Preferably, two or more rectangular-shaped compartments 25 are formed in the front or rear portions of the bag by quilting the inner and outer layers together. Preferably, the front and rear portions are mirror images of each other; each portion 11, 14 comprising two same-sized compartments 25; with at least one, most preferably about half, of the compartments 25 holding the coolant material.

Suitable coolants for use herein are liquid or gel at room temperature and freeze when placed in a conventional household-type freezer at between about 25 and 31 degrees Fahrenheit for several hours. The coolant need not freeze rigid, but should maintain a temperature of between about 30 and 65 degrees Fahrenheit for several hours at room temperature after being removed from the freezer. The bag of the present invention may be made of a material, or comprise one or more layers of material, which insulates the coolant and prolongs the maintenance of cool temperatures over time. Suitable coolants, which are also called ice substitutes or cooler retention substances, are nontoxic. Water with an antimicrobial substance dissolved in it is suitable, though less preferred. Gel coolant material is preferred.

The cooler bag of the present invention can be carried as is, or it can be placed inside another container, such as a backpack, bookbag, tote bag, briefcase, diaper bag, or larger cooler, for transport. If need be, the present bag can be used to cool items inside a large ice chest, and can later be taken out and used to store a few items previously stored in the large ice chest. This is useful, for example, on a long road trip, where food items from the ice chest are being consumed along the way. Towards the end of the trip, there is no need to try to keep the large ice chest cool when the few remaining items can be stored within the bag of the present invention. This cooler bag can be brought to the races, to ball games, hiking, camping, fishing, and to school. It can be used to store cans, bottles, various containers, food items, or medicines, for example.

The bag 10 may fit into an outer sleeve of a material, preferably a fabric, which insulates the coolant and absorbs or prevents sweat on the outside of the bag from wetting the user's hands, clothing, purse, briefcase, etc. The outer sleeve may also provide cushioning of the bag's contents against impact, and protection from inadvertent puncture. An outer sleeve with a flat bottom is preferred to hold the bag erect when it is placed on a flat surface. The outer sleeve may have attached carry straps and be used as a carry bag, such as a soft cooler, diaper bag, or lunch bag.

Figure 7:
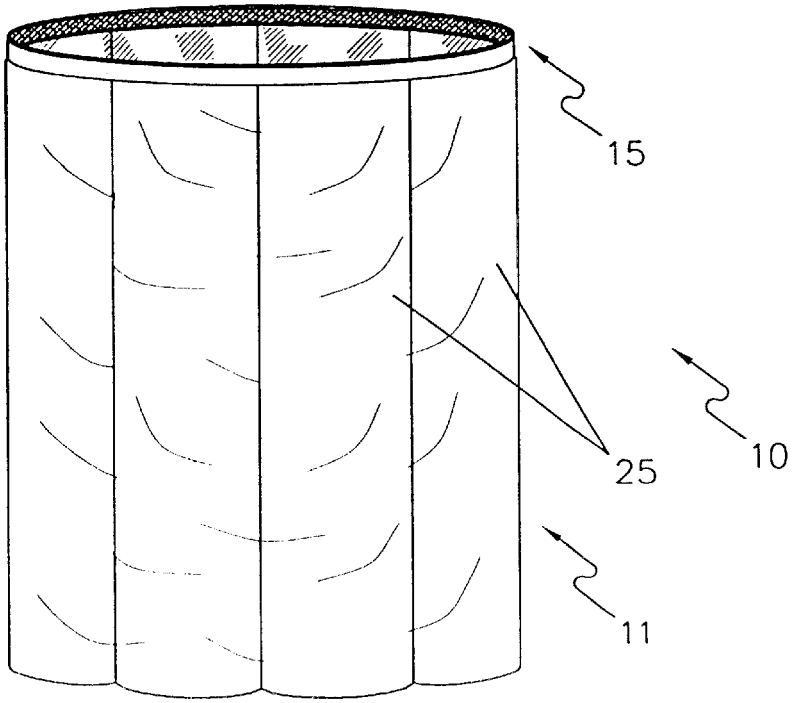
FIG. 7 is a perspective view of a third, alternate embodiment of a cooler bag according to the present invention.

Referring to FIG. 7, an alternate embodiment of the bag has eight vertical compartments 25, four in the front portion 11 and four in the rear portion 14, and a lock and loop fastener mechanism 15. In the multiple compartment embodiments of the present invention (see, e.g., FIGS. 2 and 7), if one compartment is accidentally punctured and the nontoxic coolant leaks out, other compartments will continue to cool the bag, and the bag need not be discarded. Different degrees of cooling can also be achieved by varying the number and arrangement of compartments carrying the coolant.

Figure 8:
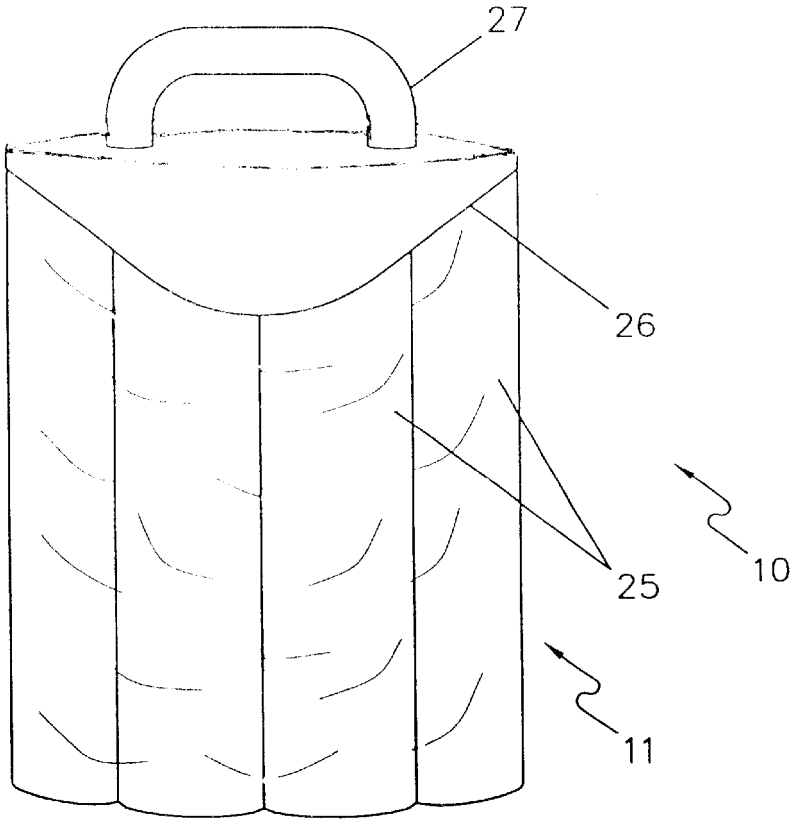
FIG. 8 is a perspective view of a fourth, alternate embodiment of a cooler bag according to the present invention.

Referring to FIG. 8, an alternate embodiment is shown with a flap closure 26 rather than a lock and loop closure, and a handle 27. The flap closure may have a snap closure attached, or a short strip of lock and loop on the inside of the flap, with a corresponding strip of lock and loop material on the outside of the front of the bag (not shown). To access the contents of the bag, a user pulls back the flap closure 26. The front portion of the bag may be slightly wider than the rear portion of the bag to allow the front to be pulled further away once the flap is open. This makes the contents more accessible. The handle 27 is attached to the top of the flap/bag. The handle 27 makes it easy to carry the bag on its own. This embodiment is especially useful as a lightweight child's lunch bag.

Figure 9:
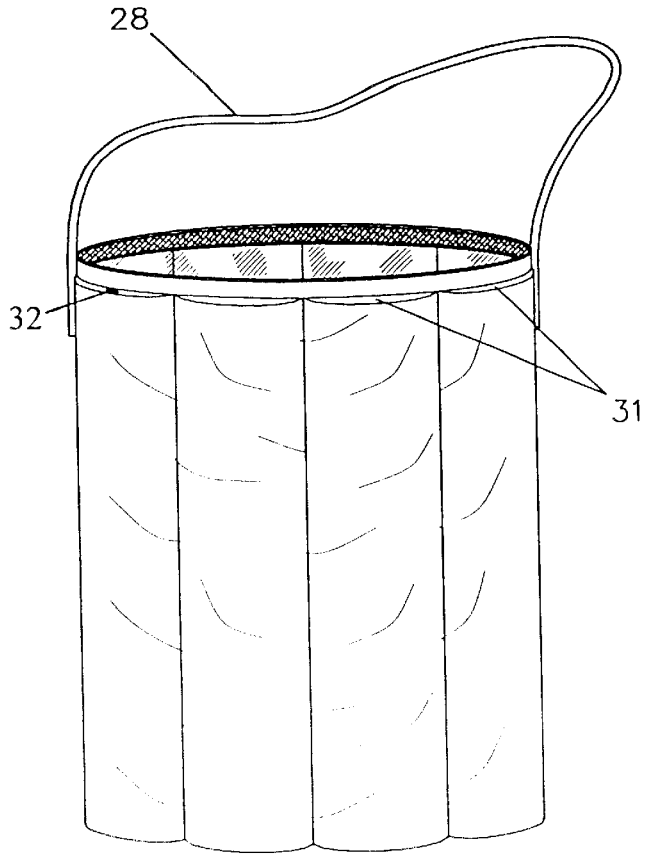
FIG. 9 is a perspective view of a fifth, alternate embodiment of a cooler bag according to the present invention.
Figure 11:
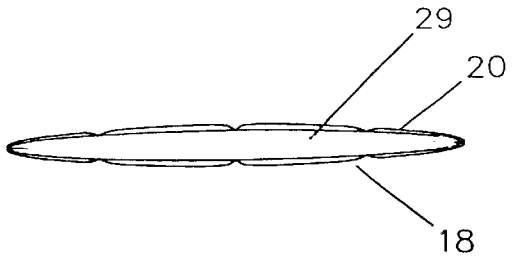
FIG. 11 is a bottom plan view of the cooler bag of FIG. 9.

Referring to FIGS. 9 and 11, an alternate embodiment of the cooler bag 10 has a carry strap 28. The bag preferably has one or two carry straps 28, each one being attached at its opposite ends to the bag 10. This embodiment has a flat bottom, which is preferably plastic, which resembles a child's wading pool. The bottom is a flexible third portion 29 attached to the front portion 11 and the rear portion 14 of the bag, as shown in FIG. 11. Rather than being two pieces sealed at the side edges, the front and rear portions may be one continuous doubled piece of plastic-type material sealed along one edge. This edge forms either the left or right side of the bag. As shown in FIG. 11, the bottom portion 29 is generally oval in shape and is preferably sealed around its periphery to the bottom edges of the front and rear portions 11, 14. The bottom portion 29 is preferably not a double layer with coolant in between the layers, like the front and rear portions. When the frozen bag 10 is placed upright, it stands erect on its bottom. This makes the contents of the bag easier to access. With this flat bottom portion 29, the bag 10 will not fall over when it is put down on a flat surface, like the floor. The bag may have a removable outer fabric covering, which fits closely over the exterior of the bag. The covering improves the appearance of the bag, and cushions and protects the contents of the bag from impact and puncturing. The bag is preferably detachable from the covering, so the covering need not be placed in the freezer with the bag. An insulative cover fabric is preferred to help maintain a cool interior environment. This embodiment is particularly useful as a convenient baby bottle/food bag.

Figure 10:
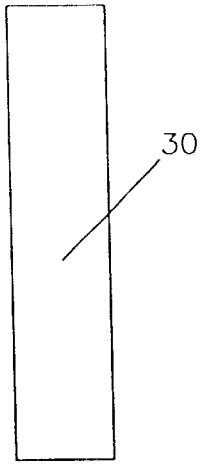
FIG. 10 is an elevational view of a coolant packet for the cooler bag of FIG. 9.

Referring to FIGS. 9 and 10, coolant for use herein may be as described above, or it may be enclosed in removable packages. A coolant packet 30 can be removed, for example, from one or two quadrants (see also FIG. 1) where cooling is not desired. Thus, the bag may be divided into a cooled portion, (e.g., for holding a baby bottle) and an uncooled portion (e.g., for holding unopened jars of baby food). Here, the compartments 25 on the outer front wall 18, and the outer rear wall 20, are open at the top to form pockets 31, as shown in FIG. 9. The coolant packets 30, or bricks, are slightly smaller than, and shaped like, the compartments, as illustrated in FIG. 10. The coolant packets 30 fit closely into the pockets 31. To use the coolant bricks, a user freezes them for several hours, and then places them in the desired compartments of the cooler bag. This allows the user to customize the bag. In this embodiment, the coolant can be placed only where it is needed.

As shown in FIG. 9, then, each compartment 25 can be formed by a pocket 31, and each pocket holds a removable packet 30 containing the coolant material. Each pocket 31 preferably comprises a second reclosable fastener mechanism 32 for fastening the opening of the pocket once the coolant packet 30 has been inserted in the pocket. After use, the fastening mechanism 32, preferably corresponding strips of lock and loop material on the inside front and rear of the pocket, can be opened and the coolant packet can be removed to clean the bag, or to freeze the coolant packet apart from the bag. FIG. 9 shows a bag 10 in an open position with eight pockets 31, with four in front. One or more pockets can have second reclosable fastener mechanisms 32.

Figure 12:
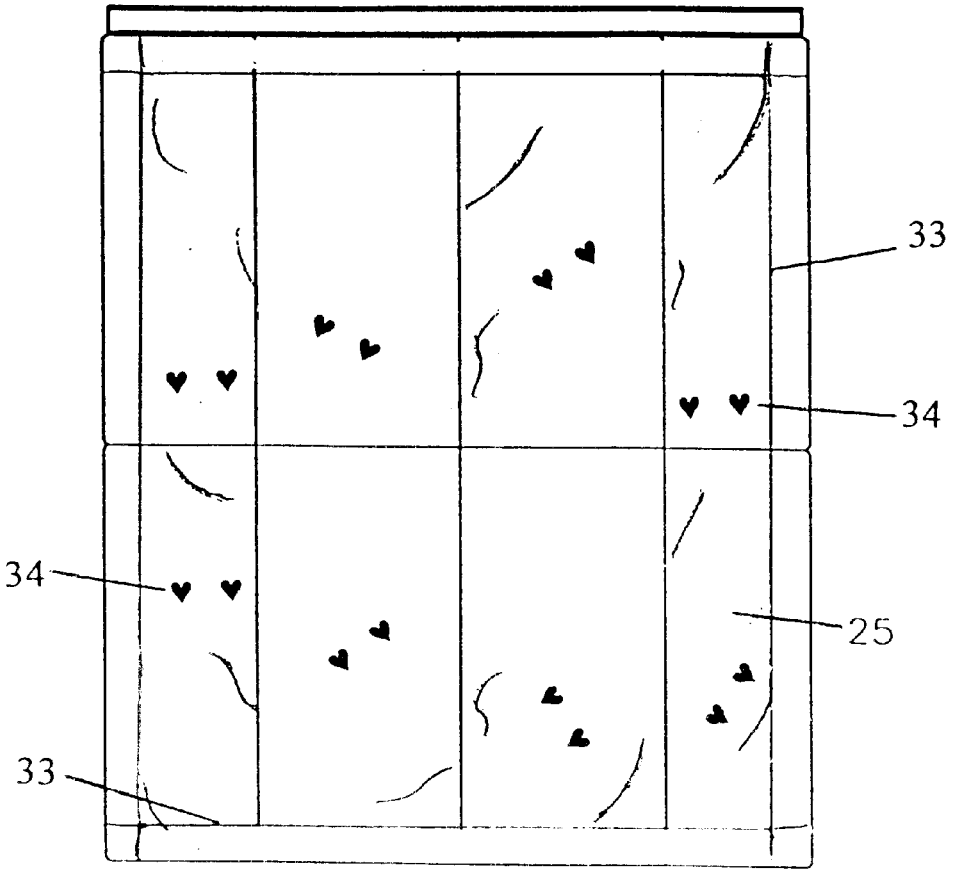
FIG. 12 is a front elevational view of a sixth, alternative embodiment of a cooler bag according to the present invention.

As shown in FIG. 12, the upper, and/or lower, edge of the front, and/or rear, portions may have double seams 33 for reinforcement. The sides of each portion, front and rear, may also have double seams 33 for reinforcement, and also to provide flexibility, which is especially important where both portions are filled with coolant material. In this case, there would be no coolant between the inner and outer seams along all four edges. A preferred embodiment of the bag 10 comprises a plurality of compartments 25, each at least partially filled with the coolant material, as shown in FIG. 12. It further comprises these reinforcing seams 33 along each edge, and a handle 27 at the top for carrying the bag. This preferred embodiment is made of a clear or opaque plastic material, and the coolant material is clear or opaque. The bag further comprises a plurality of decorative FIGS. 34 or shapes, which can be seen floating in the coolant material, as shown in FIG. 12. The FIGS. 34 can be, for example, animals, plants, such as flowers, designs, such as hearts, or cartoon characters, such as a mermaid. This embodiment appeals to children.

Figure 13:
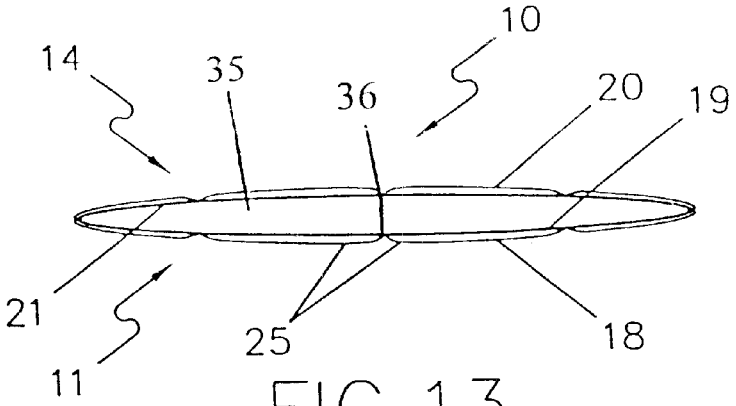
FIG. 13 is a top plan view of a seventh, alternative embodiment of a cooler bag according to the present invention.

As shown in FIG. 13, the interior of the bag is divided into two sections 35 by an interior wall 36 between the front and rear portions 11, 14. One interior section (either the left or right section, as shown in FIG. 13) is bordered by front and rear portion compartments 25 containing the coolant material, and an adjacent interior section 35 is bordered by front and rear portion compartments 25 that are not filled with coolant material. Food items or beverages that require cooling can be stored in the cooled section, and other items that do not require cooling can be stored in the section on the other side of the bag.

With testing to assure a desired internal temperature, bags according to the present invention could also be used by medical personnel to transport human organs or tissues from one hospital to another. Cooler bags 10 can be used as an ice pack normally would be used. For example, a user could place an injured hand or foot in a frozen bag of the present invention to reduce swelling and/or blood flow.

From the foregoing it can be realized that the described device of the present invention may be easily and conveniently utilized as a cooler bag. It is to be understood that any dimensions given herein are illustrative, and are not meant to be limiting.

While preferred embodiments of the invention have been described using specific terms, this description is for illustrative purposes only. It will be apparent to those of ordinary skill in the art that various modifications, substitutions, omissions, and changes may be made without departing from the spirit or scope of the invention, and that such are intended to be within the scope of the present invention as defined by the following claims. It is intended that the doctrine of equivalents be relied upon to determine the fair scope of these claims in connection with any other person's product which fall outside the literal wording of these claims, but which in reality do not materially depart from this invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is:

1. A reusable, multi-layered cooler bag for maintaining a cool temperature within the bag, the bag comprising:

(a) a front portion comprised of at least one front layer, the front layers being identical to one another;

(b) a rear portion comprised of at least one rear layer, the rear layers being identical to one another, the front portion being sealed to the rear portion along at least two of its edges, the bag having a closable opening at its upper end;

(c) a reclosable fastener mechanism for opening and closing the opening in the bag; and (d) a removable fabric outer covering, which fits closely over the exterior of the bag;

wherein the front or rear portions further comprise non-toxic coolant material between at least two of the front or rear layers; two or more rectangular-shaped compartments are formed in the front or rear portions of the bag by the quilting of the inner and outer layers together; and the bag comprises a water-tight interior for storing items to be kept cool.

2. A bag according to claim 1, wherein the interior of the bag is divided into two sections by an interior wall between the front and rear portions.

3. A bag according to claim 2, wherein one interior section is bordered by front and rear portion compartments containing the coolant material, and an adjacent interior section is bordered by front and rear portion compartments that are not filled with coolant material.

4. A bag according to claim 1, wherein each compartment is formed by a pocket, each pocket holding a removable packet containing the coolant material.

5. A bag according to claim 4, wherein each pocket comprises a second reclosable fastener mechanism for fastening the opening of the pocket once the coolant packet has been inserted in the pocket.

6. A bag according to claim 1, wherein the bag comprises a plurality of compartments, each at least partially filled with the coolant material; and further comprises reinforcing seams along each edge, and a handle at the top for carrying the bag.

7. A bag according to claim 6, wherein the bag is made of a clear or opaque plastic material, the coolant material is clear or opaque, and the bag further comprises a plurality of decorative figures or shapes suspended in the coolant material.

* * * * *